US006755259B2

(12) United States Patent
Peltola et al.

(10) Patent No.: US 6,755,259 B2
(45) Date of Patent: Jun. 29, 2004

(54) PIERCING DEVICE FOR FIRE-FIGHTING SYSTEM

(75) Inventors: Esa Peltola, Tampere (FI); Mikko Asumaniemi, Tampere (FI)

(73) Assignee: Bronto Skylift Oy Ab (FI)

( * ) Notice: Subject to any disclaimer, the term of this patent is extended or adjusted under 35 U.S.C. 154(b) by 0 days.

(21) Appl. No.: 10/346,408

(22) Filed: Jan. 17, 2003

(65) Prior Publication Data

US 2003/0230414 A1 Dec. 18, 2003

(30) Foreign Application Priority Data

Jun. 3, 2002 (FI) ..... 20021060

(51) Int. Cl.[7] ..... A62C 2/00

(52) U.S. Cl. ..... 169/47; 169/24; 169/62; 169/70; 239/73; 239/271

(58) Field of Search ..... 169/43, 47, 24, 169/52, 62, 70; 239/71, 73, 159, 164, 165, 166, 271

(56) References Cited

U.S. PATENT DOCUMENTS

| | | | | | |
|---|---|---|---|---|---|
| 2,993,650 | A | * | 7/1961 | Badberg | 239/271 |
| 3,820,606 | A | * | 6/1974 | Terayama | 239/271 |
| 4,147,216 | A | * | 4/1979 | Schnepfe et al. | 169/70 |
| 4,271,909 | A | * | 6/1981 | Chatfield et al. | 169/70 |
| 4,676,319 | A | * | 6/1987 | Cuthbertson | 169/70 |
| 4,802,535 | A | | 2/1989 | Bakke | |
| 5,062,486 | A | * | 11/1991 | McClenahan | 169/70 |
| 5,211,245 | A | | 5/1993 | Relyea et al. | |
| 5,253,716 | A | * | 10/1993 | Mitchell | 169/70 |
| 5,301,756 | A | * | 4/1994 | Relyea et al. | 169/24 |
| 5,368,106 | A | * | 11/1994 | Coughlin | 169/70 |
| 5,788,158 | A | | 8/1998 | Relyea | |
| 5,839,664 | A | | 11/1998 | Relyea | |
| 5,899,276 | A | | 5/1999 | Relyea et al. | |
| 5,913,367 | A | * | 6/1999 | Hampton | 169/70 |
| 6,340,060 | B1 | | 1/2002 | Larsson et al. | |

FOREIGN PATENT DOCUMENTS

| | | |
|---|---|---|
| GB | 2 140 432 A | 7/1985 |
| GB | 2 257 357 A | 1/1993 |
| WO | WO 99/08753 | 2/1999 |
| WO | WO 01/98031 A1 | 12/2001 |

* cited by examiner

*Primary Examiner*—Steven J. Ganey
(74) *Attorney, Agent, or Firm*—Leydig, Voit & Mayer, Ltd.

(57) ABSTRACT

A method and an apparatus for punching a piercing tool through a wall shell structure and for feeding fire-retardant medium to the object on fire. At the outermost end of the rescue boom (3), according to the invention, there is a piercing device (6) which comprises an elongated piercing tool (7) provided with at least one longitudinal channel for supplying the fire-retardant medium to the nozzles of the tool (7) and further to the object on fire. The piercing device (6) comprises an actuator for advancing the piercing tool (7) through the shell structure (8) by a longitudinal movement.

23 Claims, 4 Drawing Sheets

PIERCING DEVICE FOR FIRE-FIGHTING SYSTEM

CLAIM OF PRIORITY

This patent application claims the benefit of Finnish Patent Application No. 20021060, filed Jun. 3, 2002, which is incorporated in its entirety herein by this reference.

1. Field of the Invention

The invention relates in general to piercing mechanisms and methods for using the same and in particular to piercing mechanisms usable in rescue booms and methods for feeding fire-retardant medium.

2. Background of the Invention

In fire fighting, it is very important to start fire-fighting measures promptly before the fire expands so that it cannot be controlled. In the case of an air crash, for example, the fire should be brought under control within the first few minutes from the onset of fire. In that case, ideally, the fire-fighting equipment is brought to the scene as fast as possible and the fire-retardant medium is quickly fed inside the object on fire without having to break down the structures. Thus, rescue booms have been devised that are placed on a movable carrier and provided with a piercing tool which can be pushed through the wall structure of the object on fire. Examples of prior piercing tools are disclosed in U.S. Patent Nos. 5,211,245; 5,301,756; 5,788,158; and 5,839,664.

The piercing tool can include a sharp point which pierces the body structures of vehicles and the like relatively easily. After piercing, fire-retardant medium can be fed directly into the object on fire. In existing devices, piercing is carried out by moving the boom parts with respect to their joints or by extending telescopic boom parts. A problem associated with operating conventional piercing tools via boom movements is that it is difficult for the user to control the boom to achieve the necessary piercing movement. Furthermore, the user does not sense the movements of the boom, which in turn can prevent his noticing whether forces are directed to the piercing tool that could damage it.

SUMMARY OF THE INVENTION

The present invention provides a new and improved arrangement for piercing a wall shell structure with a piercing tool. The present invention is particularly useful in fire fighting. The method of the invention maintains a rescue boom in a substantially stationary position during a piercing operation carried out by driving a piercing tool through a wall shell structure by means of an actuator provided at the end of the rescue boom.

The boom can be provided with at least one piercing device, which comprises at least one elongated piercing tool. The piercing device can be mounted to the rescue boom. The piercing device can include at least one actuator for moving the piercing tool in its longitudinal direction. The piercing tool can move along its longitudinal direction with respect to the outermost end of the boom. The actuator can generate a longitudinal movement in the piercing tool, without moving the boom, for advancing the tool through a wall shell structure confining a fire. With the piercing tool being punched through the wall shell structure by a quick longitudinal movement, the forces needed for piercing can be relatively small.

An advantage of the invention is that the actual piercing is carried out by a separate actuator and, unlike in prior art solutions, without moving the boom. It is considerably easier and faster to carry out piercing by the piercing tool of the present invention than by moving a long boom. Furthermore, damage to the piercing tool can be avoided.

The actuator can include at least one spring member for punching the piercing tool through the wall shell structure. In another aspect of the invention, the actuator can include at least one pressure medium cylinder for pushing the piercing tool with respect to the boom end.

A front end of the piercing device can be provided with a plunger, which can be pressed by a pre-determined force against the wall structure for the piercing thereof such that the yielding of the wall structure from the piercing forces can be avoided. Furthermore, the plunger may locally deform the place to be pierced, which also facilitates the piercing.

In one aspect of the invention, a method for feeding fire-retardant medium from a first side wall of a shell structure to its second side is provided. The outermost end of a rescue boom can be positioned in the immediate vicinity of the first side of the shell structure. The shell structure can be pierced by pushing at least one elongated piercing tool provided at the outermost end of the rescue boom. At least a portion of the piercing tool can be pushed from the first side of the wall structure to the second side thereof. Fire-retardant medium can be fed through at least one longitudinal channel provided in the piercing tool and through at least one nozzle connected to the channel out of the piercing tool within the space bound by the second side of the shell structure.

In another aspect of the invention, a rescue boom can include one or more moveable boom parts. The rescue boom can include a first end connected to a carrier and a second end, which is furthest away from the carrier. A piercing tool can be provided adjacent the second end of the boom. The piercing tool can be an elongated member having at least one longitudinal channel. A feed channel can be provided for feeding fire-retardant medium into the channel of the piercing tool. A nozzle can be provided which is connected to the channel of the piercing tool for feeding the fire-retardant medium therethrough. Means for adjusting the angular position of the piercing tool with respect to the outermost end of the boom can also be provided.

In yet another aspect of the invention, a piercing device can be provided which includes a piercing tool in the form of an elongated member having a longitudinal channel, a feed channel for feeding fire-retardant medium into the channel, and a nozzle which can be connected to the channel and through which the fire-retardant medium is arranged to be fed.

The features of the present invention will become apparent to one of ordinary skill in the art upon reading the detailed description, in conjunction with the accompanying drawings, provided herein.

BRIEF DESCRIPTION OF THE DRAWINGS

For the sake of clarity, the figures illustrate the invention in a simplified manner. In the figures, like reference numbers refer to like elements.

DETAILED DESCRIPTION OF EMBODIMENTS OF THE INVENTION

Figure 1:
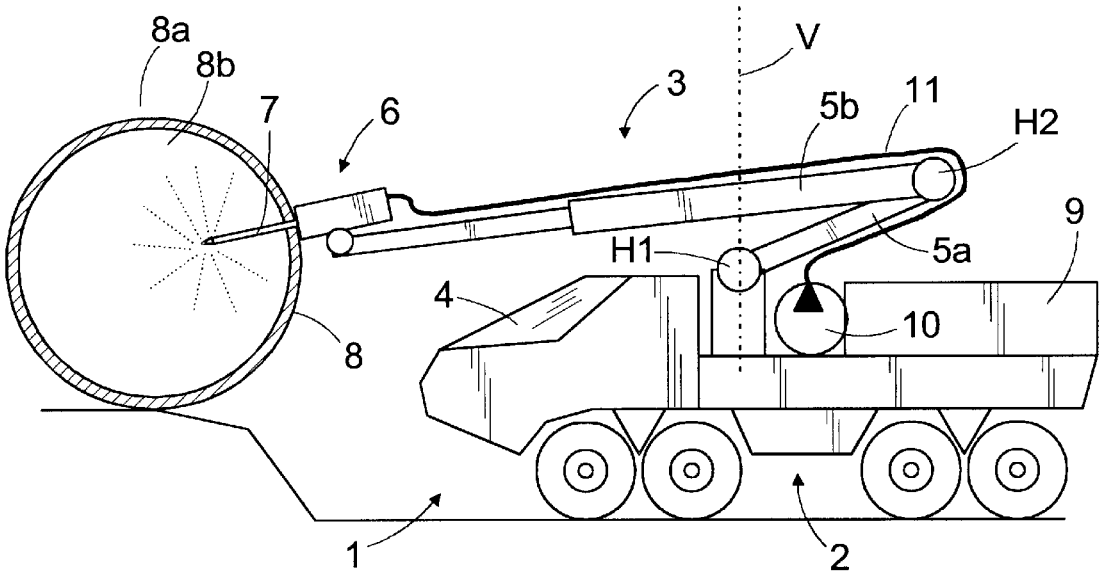
FIG. 1 schematically illustrates a rescue vehicle equipped with a piercing device according to the present invention.

FIG. 1 shows a rescue vehicle 1, which comprises an independently movable carrier 2, which may be any appropriate vehicle, for example, an all-terrain vehicle similar to the one shown in FIG. 1. Alternatively, the movable carrier may be a trailer or a ship. On the carrier 2, there is a rescue boom 3, which can include at least one boom part which can be moved with respect to the carrier 2. In the embodiment shown in FIG. 1, the boom 3 is arranged behind a control cabin 4. The rescue boom 3 includes a movable boom with a first boom part 5*a*, whose first end is connected to the carrier 2 so that the boom part 5*a* can be rotated about a vertical axis V. Furthermore, a horizontal joint H1 enables lifting and lowering of the second, i.e., the outermost, end of the boom part 5*a*. A second boom part 5*b* is connected to the outermost end of the first boom part 5*a*. The outermost end of the second boom part can be lifted and lowered with respect to a horizontal joint H2 between the first boom part 5*a* and the second boom part 5*b*. The boom parts 5*a*, 5*b* may be moved, for example, by pressure medium cylinders and motors or by another known manner. For the sake of clarity, the actuators for a moving boom are not shown in FIG. 1.

The outermost end of the boom 3 includes a piercing device 6, which can have an elongated sharp-pointed piercing tool 7 and means for moving the piercing tool 7 over a predetermined range of travel from the side of the first surface 8*a* of the wall structure 8 to the side of its second surface 8*b*. The outermost end of the piercing tool 7 may be provided with one or more nozzles. The carrier 2 is further provided with a container 9 for storing fire-retardant medium. Fire-retardant medium can be pumped by a pump along a feed channel 11 to the piercing device 6. The fire-retardant medium can be conveyed to the piercing device 6 at a pressure of about 7 bars, for example. The feed channel 11 is connected to the piercing tool 7, which is provided with one or more longitudinal channels that can be used for feeding the fire-retardant medium to one or more nozzles of the piercing tool 7. The outermost end of the piercing tool 7 may be provided with one or more nozzles. The nozzles are arranged so as to achieve a desired spray pattern.

Referring to FIG. 1, the carrier 2 has been driven next to a fuselage, after which the piercing device 6 has been brought against the outer surface 8*a* of the fuselage by moving the boom 3. Then the boom 3 is kept stationary and the piercing is carried out by punching the piercing tool 7 through the wall shell structure 8 of the fuselage. After this, fire-retardant medium can be fed into the space 8*b* defined by the second surface 8*b* of the wall structure 8 using the piercing tool 7. The wall structure 8 can be pierced several times. The fire-retardant medium may be water, mist consisting of water and gas, fire foam, fire-fighting chemical, fire-fighting gas, another suitable solid, liquid or gaseous substance, or a mixture thereof. After a necessary amount of fire-retardant medium has been fed, the piercing tool 7 can be pulled out of the wall structure 8 by means of the piercing device 6, and the piercing device 6 can be taken to a new location by moving the boom 3 where the piercing and the feeding of fire-retardant medium can be performed again. To avoid damage to the piercing tool 7, the boom 3 may be prevented from moving during the piercing.

Figure 2:
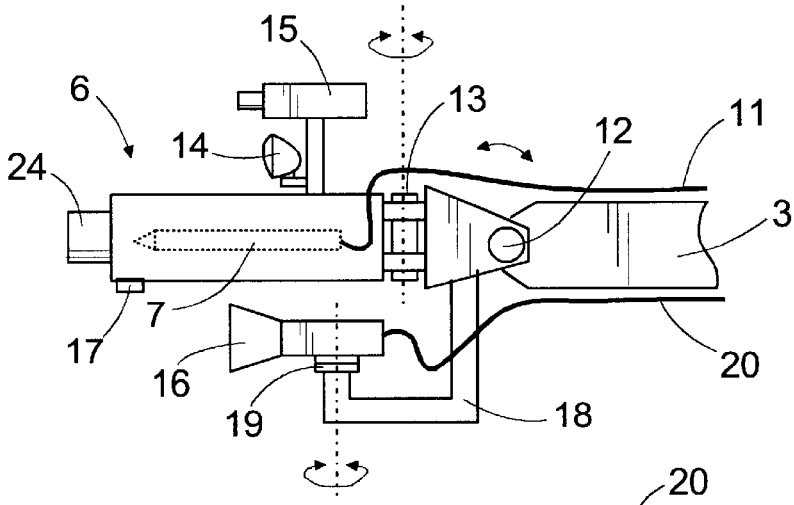
FIG. 2 is a schematic side view of the outermost end of a rescue boom according to the invention.
Figure 9:
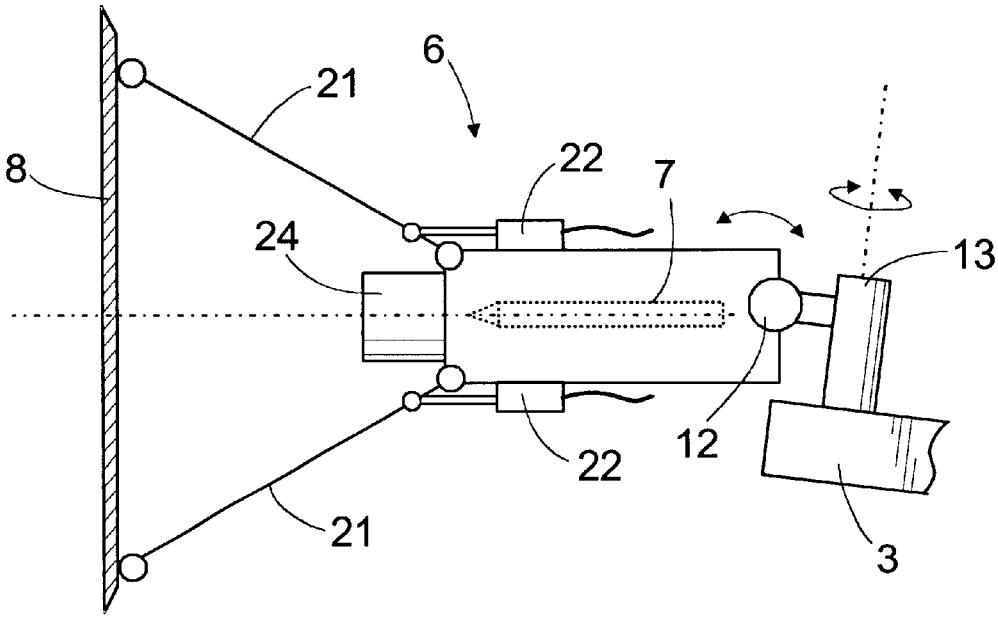
FIGS. 9 and 10 schematically illustrate arrangements for positioning the piercing device of the invention with respect to the wall structure to be pierced.
Figure 10:
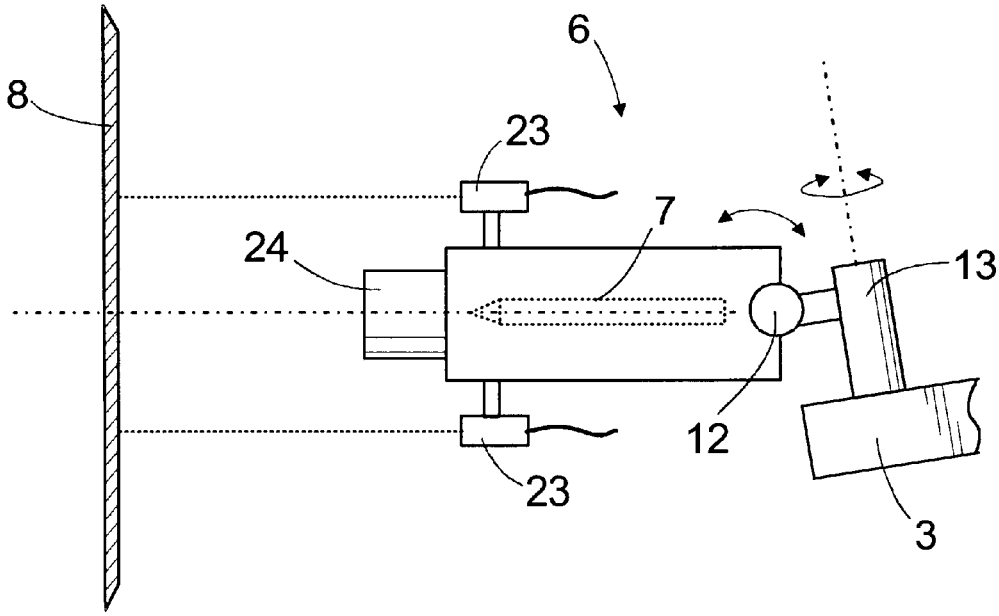

Referring to FIG. 2, the boom 3 can include means for adjusting the position of the piercing device 6 with respect to the boom 3. The means may include one or more joints 12, 13 with respect to which the piercing device 6 may be moved by suitable actuators so that the longitudinal axis of the piercing tool 7 is substantially perpendicular to the outer surface 8*a* of the wall structure 8 to be pierced. With such an adjusting system, it is not necessary to position the entire boom 3 with respect to the wall structure 8 to put the piercing device 6 in a desired position. The position of the piercing device 6 with respect to the end of the boom 3 can be adjusted quickly and easily by the adjusting system. Cross-directional loads on the piercing tool 7 can be avoided by positioning the piercing tool 7 substantially perpendicular to the outer surface 8*a* of the wall structure 8. Furthermore, the piercing effectiveness can be increased with the piercing force directed perpendicularly to the surface 8*a* of the wall structure. FIGS. 9 and 10 illustrate some arrangements for adjusting the position between the piercing device 6 and the wall structure 8 to be pierced.

Figure 3:
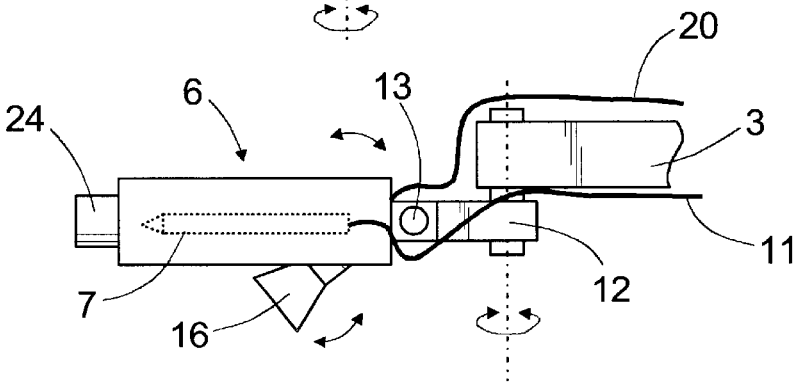
FIG. 3 is a schematic top view of the outermost end of the rescue boom shown in FIG. 2.

Referring to FIG. 2, the outermost end of the boom 3 and the piercing device 6 can both be provided with one or more lights 14, video cameras, thermographic cameras 15, and sensors 17, for example, temperature sensors. Furthermore, the outermost end of the boom 3 may comprise one or more non-piercing nozzles 16 for feeding fire-retardant medium. Each nozzle 16 and its support structure 18 may be arranged to turn together with the piercing device 6 with respect to the joint 12. In addition, each nozzle 16 may be arranged to turn by means of a joint 19 with respect to the support structure 18, in which case it can be turned sideways independently, as shown in FIG. 3. The fire-retardant medium is supplied from the carrier 2 along a feed channel 20 to the nozzle 16. For the sake of clarity, FIG. 3 does not show the auxiliary devices illustrated in FIG. 2.

Figure 4:
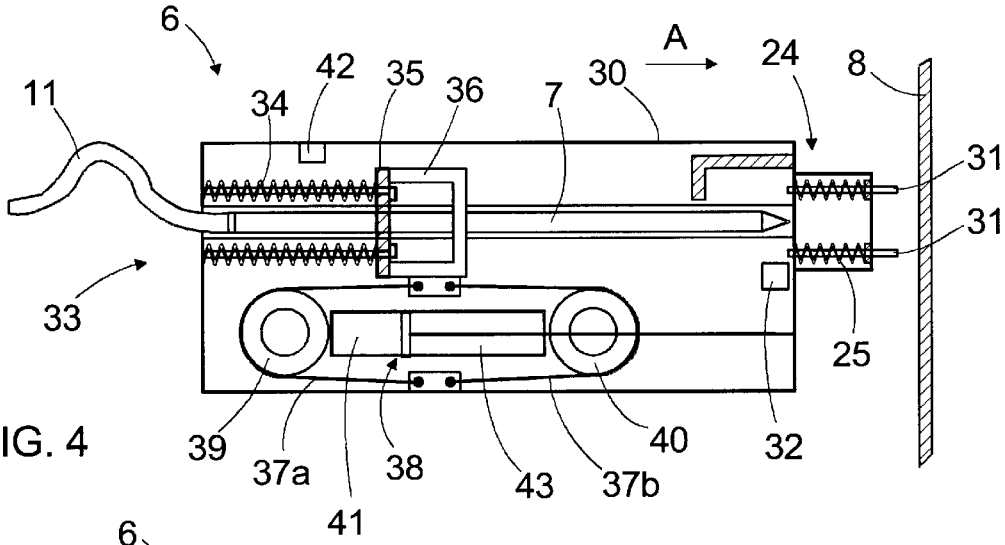
FIGS. 4, 5 and 6 are schematic sectional views of the piercing device in different positions.

FIG. 4 illustrates a piercing device 6 at a standstill where the piercing tool 7 is inside a casing 30. In the front of the piercing device 6 there is a plunger 24, which can be pressed against the wall structure 8 by moving the boom 3 in direction A. The plunger 24 may comprise a plurality of pins 31 which are biased by springs 25 and whose movement a detector 32 can detect. Alternatively, the plunger 24 can include a compressible pressure space which contains pressure medium and whose pressure is monitored by a sensor. The piercing device 6 can include an actuator 33 as a means for moving the piercing tool 7 over a predetermined range of travel. The actuator 33 can remain idle until the sensor 32 detects that the piercing device 6 is pressed against the wall structure 8 at a pre-determined force by monitoring the movement of the pins 31. Since charging and discharging the actuator 33 requires that a certain force act on the plunger 24, the safety of operating the piercing device 6 can be enhanced. In addition, information can be transmitted from the detector 32 to the control unit of the device, which can act to prevent the boom 3 from moving after the plunger 24 has been pressed against the wall structure 8 by a predetermined force.

The actuator 33 can include one or more spring members 34, for example, coil springs, which are arranged to act on a cradle 36 by means of a push plate 35. The cradle 36 is connected to the piercing tool 7 and arranged to be moved by a pressure medium cylinder 38 using chains 37*a*, 37*b* or similar power transmission means. The cylinder 38 may be driven by pressure fluid or pressurized gas. The cylinder 38 can be provided with a pair of idler wheels 39, 40, around which the chains 37*a*, 37*b* are arranged. The first ends of the chains 37*a*, 37*b* are connected to the cradle 36 and their second ends are connected immovably to the frame of the piercing device 6. This structure enables generation of the necessary charging movement by a short movement of the cylinder 38.

Figure 5:
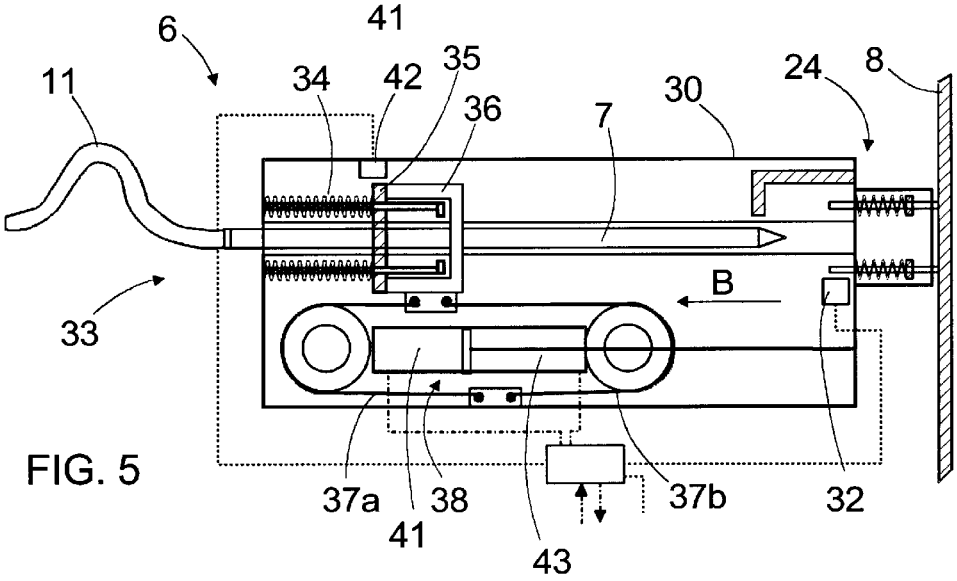
Figure 6:
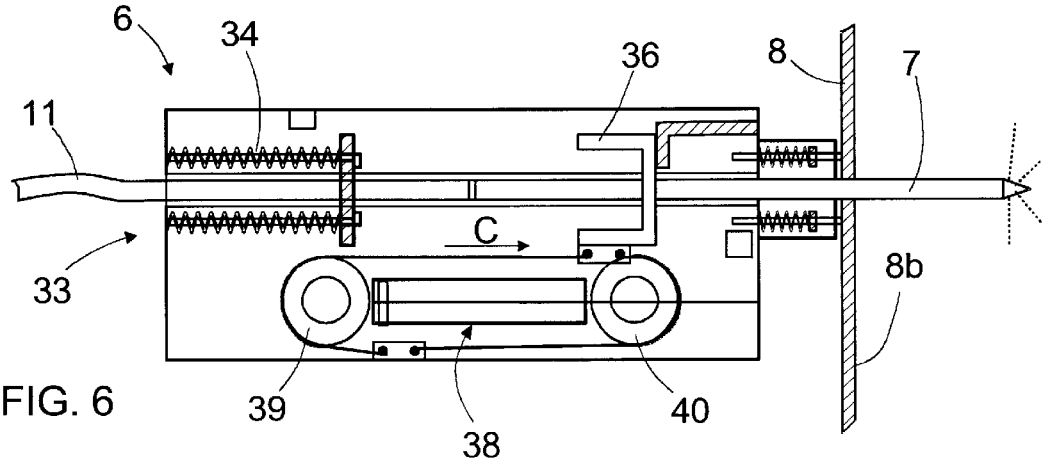

Referring to FIG. 5, the plunger 24 is pressed against the wall structure 8. Pressure medium can be supplied to a first pressure space 41 of the cylinder 38, thereby moving the cylinder 38 in direction B, to the left as shown in FIG. 5. The chain 37*a* draws the cradle 36 in direction B. The cradle 36, in turn, presses the springs 34 together by means of the push plate 35, thereby charging the actuator 33 for the impact. The amount of the impact energy can be adjusted by varying the number and properties of the springs 34 as well as by varying how much the springs 34 are compressed. Compression of the springs 34 can be monitored by a detector 42. When the desired compression has been achieved, a connection can be opened from the pressure space 41 of the cylinder to a discharge channel. The spring force pushes the cradle 36, the piercing tool 7 and the cylinder 38 toward the front of the piercing device 6 in direction C, to the right as shown in FIG. 6, by a rapid impact-like movement. The sharp point of the piercing tool 7 pierces the wall structure 8, allowing the tool 7 to penetrate to the side of the second surface 8*b* of the wall structure 8.

If the piercing tool 7 does not pierce the wall structure 8 in a desired fashion, pressure medium can be fed to the second pressure space 43 of the cylinder 38 and the cylinder 38 can urge the piercing tool 7 in direction C.

After the piercing has been carried out and the fire-retardant medium has been fed, pressure medium can be supplied to the first pressure space 41 of the cylinder 38. The cylinder 38 can draw the piercing tool 7 back inside the casing 30 of the piercing device 6.

Figure 7:
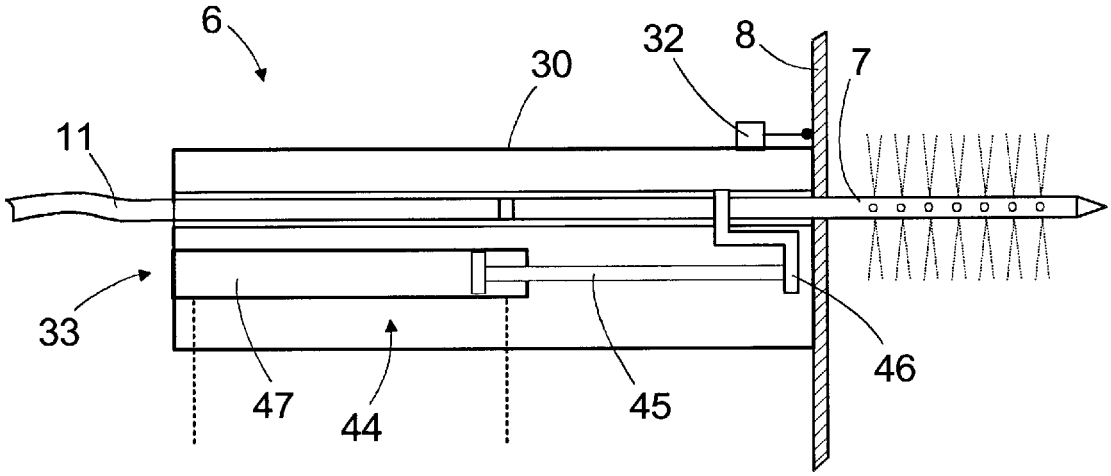
FIG. 7 is a schematic and sectional view of another embodiment of a piercing device according to the present invention.

FIG. 7 illustrates a piercing device 6 where the means for moving the piercing tool 7 includes an actuator 33 driven by pressure medium. The actuator can be a hydraulic or a pressure medium cylinder 44 having a piston rod 45 connected to the piercing tool 7 by way of a pusher 46. The actuator 33 can be driven by supplying a pressure medium flow from a pressure accumulator or the like to the first pressure space 47 of the cylinder 44 and by directing a rapid impact-like movement to the piercing tool 7 in the longitudinal direction. Alternatively, the piercing tool 7 can be advanced through the wall structure 8 by means of the cylinder 44 using a lower speed. A detector 32 can be provided at the front of the piercing device 6 for detecting the position of the piercing device 6 with respect to the wall structure 8.

In another embodiment, the means for moving the piercing tool 7 can include an electric actuator 33, such as a solenoid, for example. The piercing tool 7 can be moved, for example, by a combination of a pressure-operated or an electric motor and mechanical power transmission means. The impact energy for punching the piercing tool 7 through the wall structure 8 can also be generated by a pyrotechnical actuator 33.

Figure 8:
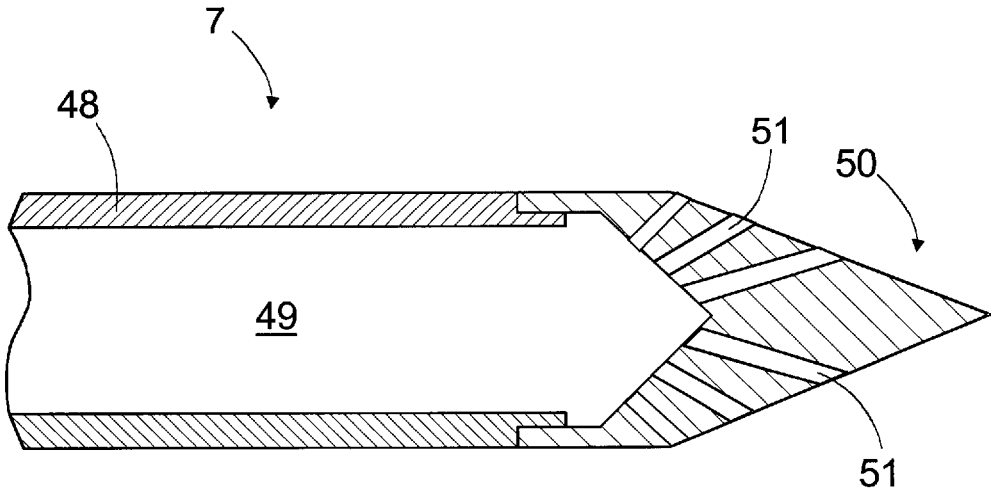
FIG. 8 is a schematic and sectional view of the end of a piercing tool.

FIG. 8 illustrates part of a piercing tool 7. The piercing tool 7 can include a longitudinal rod 48 having at least one channel 49 for feeding fire-retardant medium. The point of the piercing tool 7 may be provided with a nozzle section 50 that is detachable to facilitate its replacement upon becoming worn. Other nozzle sections 50 where the number and direction of the nozzles 51 are different can also be mounted to the piercing tool 7. A desired spray pattern can be achieved by changing the nozzle section 50. In some embodiments, the longitudinal channel 49 provided in the piercing tool 7 may not extend up to the point of the piercing tool 7 but rather to a nozzle or nozzles arranged in the rod 48 of the piercing tool 7 close to its free end, as illustrated in FIG. 7. The nozzle 51 may be a bore extending from the channel 49 to the outer surface of the tool 7.

In another embodiment, the nozzle section can be adapted to produce a cooling effect within the interior space defined by the wall structure. The nozzle section can include a plurality of conical-shaped nozzles that are adapted to disperse the fire-retardant medium within the space defined by the wall structure such that the fire-retardant medium reduces the ambient temperature therein. The vehicle can be equipped with a high-pressure pump for conveying the fire-retardant medium to the piercing tool 7 under pressure, at about 300 bars, for example, to the temperature-reducing nozzle section for facilitating the cooling effect of the fire-retardant medium.

Furthermore, the piercing device 6 may comprise suitable attachment members by means of which it can be easily attached to and detached from different booms 3. Thus, the piercing device 6 may be fixed to the boom 3 or it may be an auxiliary device which can be movably mounted to the boom 3 when necessary.

Referring to FIG. 9, a piercing device 6 which includes at least two bars 21 extending a predetermined distance to the front of the piercing device 6 is shown. The bars 21 are connected to sensors 22 from which information can be transmitted to the control unit of the apparatus. When the boom 3 is moved toward the wall structure 8 to be pierced, the bars 21 can be pressed against the wall structure 8. If the shaft of the piercing tool 7 is not substantially perpendicular to the wall structure 8, the bars 21 are not pressed evenly against the wall structure 8, which is detected by the sensors 22. An undesired angular position can be adjusted by turning the piercing device 6 with respect to the end of the boom 3 via the joints 12, 13. The control system may be arranged to automatically keep the piercing device 6 in the desired position with respect to the wall structure 8, for example, a perpendicular relationship. Thus, the user may readily bring the piercing device 6 in the desired position by moving the boom 3 such that the bars 21 engage the wall structure 8 with the control system adjusting the position of the piercing device 6 to dispose the device 6 in the desired position.

Referring to FIG. 10, in another embodiment, the position between the piercing device 6 and the wall structure 8 can be monitored by two or more proximity sensors 23. The proximity sensors 23 may be ultrasound transmitters/receivers, inductive sensors, or other appropriate detectors, for instance.

The invention may be applied in rescue operations involving various vehicles, such as, aircraft, railway rolling stock, watercraft and road transport vehicles, for example. The wall structures of vehicles usually comprise a relatively thin metal or composite shell, which can be pierced relatively easily by punching the piercing tool through the wall structure. The invention can also be used in fire fighting in buildings since the piercing tool can be punched through typical wall and roof structures. For example, the piercing tool can readily pierce wooden structures of buildings and metal-sheeted warehouses and industrial premises, as well as tin, felt and tile roofs. Furthermore, the piercing tool can break or pierce the window of a building or vehicle. The invention is also applicable in the piercing of various tanks, containers, and the like.

The piercing tool may also be brought through only one shell structure of a wall, in which case fire-retardant medium can be fed inside the wall structure.

The drawings and the related description are only intended to illustrate the inventive concept. The details of the invention may vary within the scope of the claims. In some cases, one boom may be provided with several piercing devices of the invention. On the other hand, one piercing device may comprise several piercing tools. In addition, the rescue boom of the invention may be placed on a fixed base instead of a movable carrier.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of feeding fire-retardant medium from a first side of a wall shell structure to a second side thereof, the method comprising:

positioning a rescue boom adjacent the first side of the wall structure;

piercing the wall structure by advancing at least a portion of an elongated piercing tool provided on the rescue boom from the first side of the wall structure to the second side thereof by operating an actuator provided in operative engagement with the piercing tool;

maintaining the boom substantially stationary during the piercing step;

feeding the fire-retardant medium through at least one longitudinal channel provided in the piercing tool and through at least one nozzle connected to the channel to the second side of the wall structure;

engaging a plunger provided on the boom with the first side of the wall structure to be pierced; and advancing the piercing tool through the wall structure only after the plunger is engaged with the wall structure by a predetermined force.

2. The method according to claim 1, wherein in the piercing step, the piercing tool punches through the wall structure by a rapid longitudinal movement.

3. The method according to claim 2, wherein in the piercing step, the piercing tool punches through the wall structure by spring force.

4. The method according to claim 1, wherein in the piercing step, the piercing tool advances through the shell structure by a pressure-operated actuator.

5. The method according to claim 1, comprising:

preventing the boom from moving after the plunger has been moved against the wall structure by the predetermined force.

6. The method according to claim 1, comprising:

monitoring the position between the piercing tool and the wall structure by at least one detector; and positioning the piercing tool in a substantially perpendicular position to the first side of the wall structure before piercing the wall structure.

7. A rescue boom comprising:

a movable boom, which comprises a proximal first end, which is connectable to a carrier, and a distal second end;

a piercing tool disposed adjacent the second end of the boom, the piercing tool being an elongated member having a longitudinal channel, the position of the piercing tool with respect to the second end of the boom being adjustable;

a feed channel for feeding fire-retardant medium into the channel of the piercing tool;

a nozzle which is connected to the longitudinal channel of the piercing tool and through which the fire-retardant medium is arranged to be fed;

at least one actuator for moving the piercing tool in its longitudinal direction with respect to the second end of the boom; and a movable plunger, the plunger operably arranged with the at least one actuator such that the at least one actuator is prohibited from actuating until the plunger is acted upon by a predetermined amount of force.

8. The rescue boom according to claim 7, wherein the position of the piercing tool with respect to the second end of the boom is adjustable via means for adjusting the angular position of the piercing tool with respect to the second end of the boom.

9. The rescue boom according to claim 7, wherein the position of the piercing tool with respect to the second end of the boom is adjustable via a plurality of joints.

10. The rescue boom according to claim 7, further comprising:

at least one detector arranged with the piercing tool for monitoring the position between the piercing tool and an object to be pierced.

11. The rescue boom according to claim 7, wherein the boom is prevented from moving upon the plunger being acted upon by a predetermined force.

12. The rescue boom according to claim 7, wherein the plunger includes a pin biased by a spring.

13. A piercing device comprising:

a piercing tool which is an elongated member comprising a longitudinal channel;

a feed channel for feeding fire-retardant medium into the channel of the piercing tool;

a nozzle which is connected to the channel of the piercing tool and through which the fire-retardant medium is arranged to be fed, at least one actuator for moving the piercing tool in its longitudinal direction; and a movable plunger, the plunger operably arranged with the at least one actuator such that the at least one actuator is prohibited from actuating until the plunger is acted upon by a predetermined amount of force.

14. The piercing device according to claim 13, wherein the actuator comprises at least one spring member for providing a longitudinal impact by the piercing tool.

15. The piercing device according to claim 14, wherein the actuator comprises at least one pressure operated cylinder which moves the piercing tool in the longitudinal direction.

16. The piercing device according to claim 14, wherein the nozzle is adapted to disperse the fire-retardant medium such that the fire-retardant medium reduces the ambient temperature.

17. The piercing device according to claim 13, wherein the actuator comprises at least one pressure operated cylinder which moves the piercing tool in the longitudinal direction.

18. A rescue boom comprising:

a movable boom, which comprises a proximal first end, which is connectable to a carrier, and a distal second end;

a piercing tool disposed adjacent the second end of the boom, the piercing tool being an elongated member having a longitudinal channel, the position of the piercing tool with respect to the second end of the boom being adjustable;

a feed channel for feeding fire-retardant medium into the channel of the piercing tool;

a nozzle which is connected to the longitudinal channel of the piercing tool and through which the fire-retardant medium is arranged to be fed;

a position detecting system for monitoring the position of the piercing tool relative to a selected surface and generating a signal conveying position data thereof;

a control unit operable to adjust the position of the piercing tool with respect to the boom, the control unit arranged with the detecting system to receive position data therefrom, and the control unit adjusting the position of the piercing tool based on the position data to dispose the piercing tool in a predetermined positional relationship with respect to the selected surface.

19. The rescue boom according to claim 18, further comprising:

an actuator for moving the piercing tool in its longitudinal direction with respect to the second end of the boom.

20. The rescue boom according to claim 18, further comprising:

a movable plunger, the plunger operably arranged with the at least one actuator such that the at least one actuator is prohibited from actuating until the plunger is acted upon by a predetermined amount of force.

21. The rescue boom according to claim 18, wherein the position detecting system includes a pair of bars extending a predetermined distance from the piercing tool, and a pair of sensors connected, respectively, to the bars.

22. The rescue boom according to claim 18, wherein the position detecting system includes two or more proximity sensors.

23. The rescue boom according to claim 18, wherein the predetermined positional relationship is a substantially perpendicular relationship between the piercing tool and the selected object.

* * * * *